US005820107A

United States Patent [19]

Hall

[11] Patent Number: 5,820,107

[45] Date of Patent: Oct. 13, 1998

[54] MULTI-USE LEVER

[76] Inventor: Kessie M. Hall, 2405 Hope St., Klamath Falls, Oreg. 97603

[21] Appl. No.: 789,617

[22] Filed: Jan. 27, 1997

Related U.S. Application Data

[60] Provisional application No. 60/014,091 Mar. 26, 1996.

[51] Int. Cl.[6] ..... B25C 11/00

[52] U.S. Cl. ..... 254/25

[58] Field of Search ..... 7/166; 254/18, 254/21, 25; 29/267

[56] References Cited

U.S. PATENT DOCUMENTS

| | | | |
|---|---|---|---|
| D. 30,892 | 5/1899 | Rawlings | 254/25 |
| D. 120,609 | 5/1940 | Arnsbarger . | |
| D. 136,804 | 12/1943 | Rea . | |
| 164,956 | 6/1875 | Anderson | 254/25 |
| D. 195,362 | 6/1963 | Geisler . | |
| D. 197,205 | 12/1963 | Estwing . | |
| D. 350,270 | 9/1994 | Jensen . | |
| 669,106 | 3/1901 | Thom . | |
| 845,672 | 2/1907 | Thompson . | |
| 898,568 | 9/1908 | Emmerson | 254/25 |
| 1,255,660 | 2/1918 | Stevens | 254/25 |
| 2,457,231 | 12/1948 | Henderson . | |
| 3,680,834 | 8/1972 | Holloway . | |
| 3,774,252 | 11/1973 | Cantales | 254/21 |
| 3,987,827 | 10/1976 | Mills | 254/25 |
| 5,075,945 | 12/1991 | Krzecki | 29/267 |
| 5,079,791 | 1/1992 | Grech | 29/267 |
| 5,438,743 | 8/1995 | Simington et al. | 29/267 |

FOREIGN PATENT DOCUMENTS

| | | | |
|---|---|---|---|
| 2166681 | 5/1986 | United Kingdom | 254/18 |

*Primary Examiner*—Robert C. Watson
*Attorney, Agent, or Firm*—Richard C. Litman

[57] ABSTRACT

A multi-use lever having a flat pry blade member and a handle lying in substantially parallel planes connected by an elongated midsection. A pair of bends provide a substantially upright configuration transitioning from the handle and pry blade member to the midsection, enabling the worker to drive and extract nails from constricted work areas, and lift heavy objects by increasing leverage exerted by the tool. A claw and eyelet defined as part of the pry blade member allow the lever to be utilized as a nail extractor. V-shaped tips of the claw provide points for digging into soft building materials and provide an edge providing a fulcrum for prying at unusual angles. The lever is made of a solid steel construction, allowing the lever to be used as a hammer, with a flattened portion functioning as the strike point.

3 Claims, 3 Drawing Sheets

MULTI-USE LEVER

CROSS-REFERENCE TO RELATED APPLICATION

This application claims the benefit of U.S. Provisional patent application Ser. No. 60/014,091, filed Mar. 26, 1996 now abandoned.

BACKGROUND OF THE INVENTION

1. Field of the Invention

The present invention relates generally to levers. More specifically, the invention relates to a multi-use lever incorporating the functions of a pry bar, nail puller, lifter and hammer.

2. Description of the Prior Art

Presently, when workers need to perform a variety of tasks they must often carry an assortment of tools. For instance, to drive or remove nails, pry apart objects or lift heavy articles, a worker would need at least a hammer and a pry bar. However, the hammer and pry bar in many instances will not provide enough leverage to lift items of significant weight. Neither the hammer, pry bar, nor any other conventional tool alone can conveniently, easily and effectively be utilized to hammer nails, reach and remove nails in hard to reach places, provide enough leverage for the removal of shingles, siding, plywood, molding, metal, carpeting, and lift heavy objects with minimum applied force.

Currently, to complete the above mentioned tasks, the worker must not only obtain different tools for each task, but must also have them available for use together at a work site. There is therefore a need for a lightweight, easy to use, and effective tool that is useful for a number of tasks including driving and removing nails, lifting heavy objects with a minimum amount of applied force, and providing sufficient leverage in the removal of shingles, siding, plywood and other materials. The present invention provides such a device.

Leverage devices have been described in the patent literature. For example, U.S. Pat. No. 2,457,231 issued to Henderson on Dec. 28, 1948, U.S. Pat. No. Des. 350,270 issued to Jensen on Sep. 6, 1994, and U.S. Pat. No. Des. 197,205 issued to Estwing on Dec. 24, 1963, all show pry bars, but fail to disclose leverage devices wherein the handle end and the pry end each is configured to include a nearly right bend resulting in a handle and pry member lying in substantially parallel planes, so as to provide an upright profile which allows leverage in constricted areas.

U.S. Pat. No. 669,106 issued to Thom on Mar. 5, 1901, U.S. Pat. No. 845,672 issued to Thompson on Feb. 26, 1907, U.S. Pat. No. 3,680,834 issued to Holloway on Aug. 1, 1972, U.S. Pat. No. Des. 136,804 issued to Rea on Sep. 10, 1943, U.S. Pat. No. Des. 120,609 issued to Arnsbarger on Feb. 17, 1940, and U.S. Pat. No. Des. 195,362 issued to Geisler on Jun. 4, 1963, all describe elongated pry bars or nail extractors, but fail to disclose a leverage device having an upright profile which allows increased leverage in constricted areas, and having with a handle and a flat blade at opposing ends to serve as a nail pry member suitable for ripping forward shingles and the like.

None of the above inventions and patents, taken either singly or in combination, is seen to describe the instant invention as claimed.

SUMMARY OF THE INVENTION

The invention relates to a multi-use lever which enables the worker to drive and extract nails, lift heavy objects and greatly increase the leverage exerted by the tool, particularly in constricted areas. The lever comprises an elongated midsection terminating with a handle made of rubber or similar material, located at a first end, and a flat pry blade member configured for prying and nail-pulling, located at a second end. A lower bend between the midsection and the pry blade member and an upper bend between the midsection and the handle each provide the lever with an upright configuration, positioning the pry blade member and handle in substantially parallel planes. Such upright configuration provides increased leverage to the tool, particularly advantageous in constricted work areas, such that a minimum amount of downward force applied to the handle produces a greater amount of force at the pry blade member.

A claw and an eyelet defined in the pry blade member each serve as a nail extractor. The eyelet is defined medially in the pry blade member, having a constricted neck for binding a nail beneath its head, allowing the lever to be levered forward and upward by means of the handle, with the claw acting as a fulcrum, to extract the nail. The claw has pointed tips for aiding in removal of deeply embedded nails; the claw is operated by levering the handle in a rearward and downward direction, using the lower bend as a fulcrum. The lever is rigid, preferably made of a solid steel construction, further allowing the lever to be used as a hammer with the lower bend functioning as the strike point.

Accordingly, it is a principal object of the invention to provide a leverage tool with an upright configuration, having a handle and pry blade member at opposing ends.

It is another object of the invention to provide a leverage tool wherein the handle and pry blade end lie in substantially parallel planes.

It is a further object of the invention to provide a leverage tool suitable for use as a hammer.

Still another object of the invention is to provide a leverage tool useful for extracting nails.

It is again an object of the invention to provide a leverage tool useful for levering and inserting beneath shingles, while remaining useful for general purpose prying as well.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
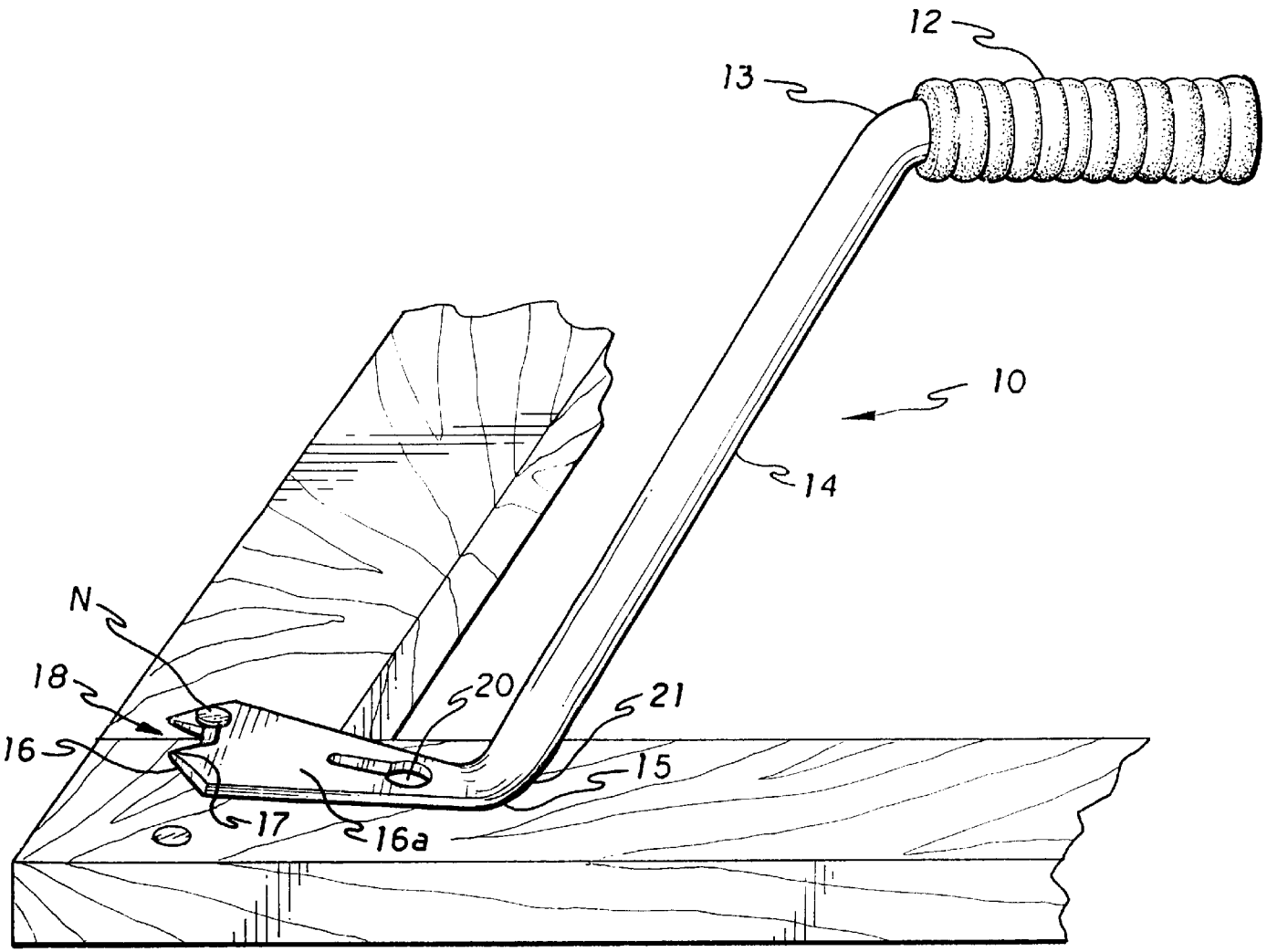
FIG. 1 is an environmental, perspective view of the present invention, showing its use in extracting a nail by employing the claw of the tool.

Turning now to FIG. 1 of the drawings, leverage tool 10 is shown having a handle 12, pry blade 16 and a midsection 14 connected between handle 12 and pry blade 16. A unitary transition between the midsection 14 and the handle and pry blade is provided by an upper bend 13, formed near handle 12, and a lower bend 15, formed near pry blade 16. The upper and lower bends 13, 15, place the handle 12 and pry blade 16 in substantially parallel planes, and provides an upright configuration during use of the tool. The bends provide accessibility to constricted areas allowing leverage when using leverage tool 10 as a prying device. Claw 18, located in pry blade 16 at the distal end of tool 10, is provided with V-shaped tips 17, providing points for digging out embedded nails. Moreover, the pry blade 16 is planar, which allows the blade to be easily inserted between overlapping articles, particularly shingles.

Figure 3:
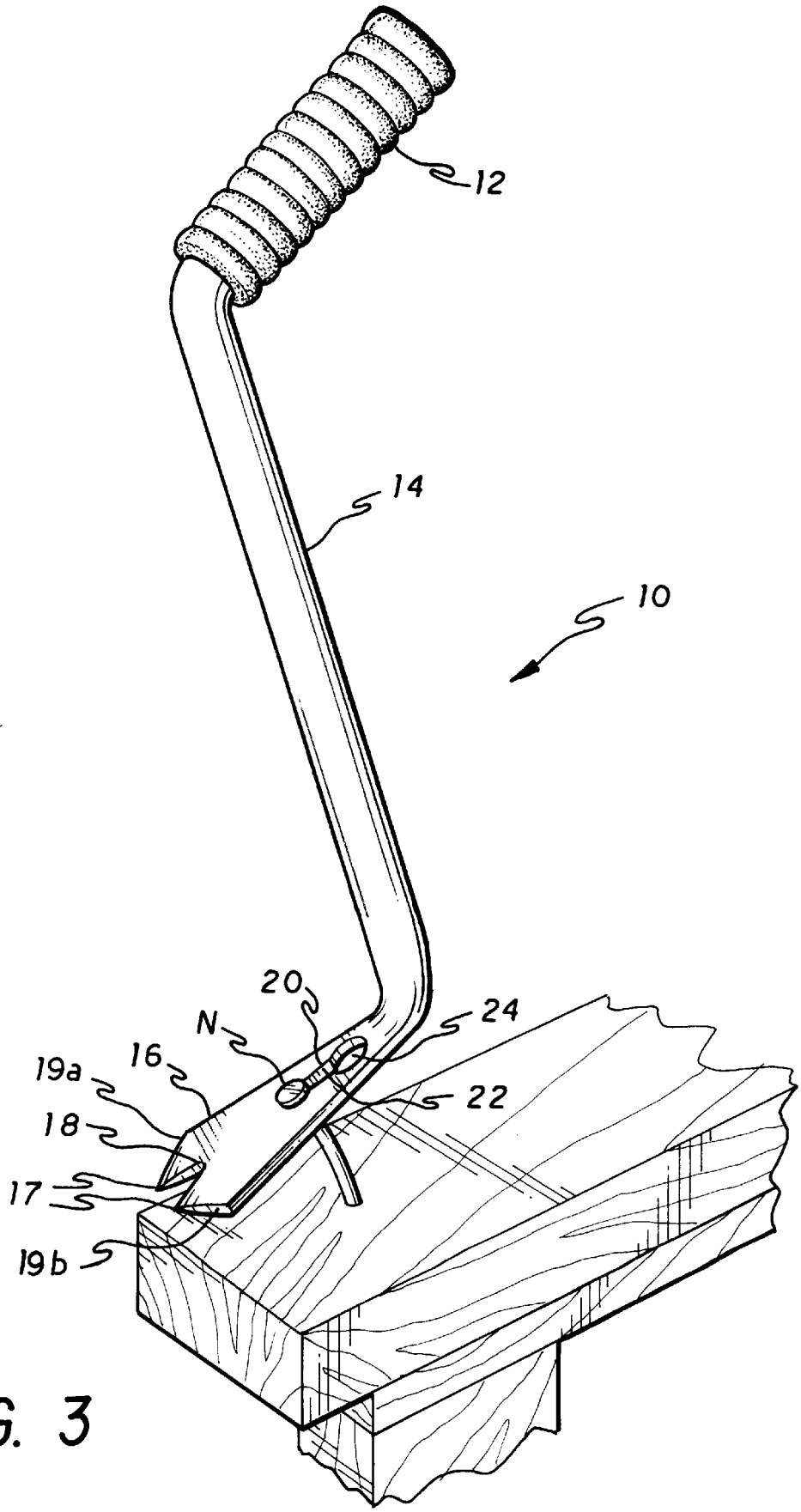
FIG. 3 is an environmental, perspective view of the present invention, showing its use to remove a nail by utilizing the eyelet of the tool.

As shown in FIGS. 1 and 3, a nail N can be extracted via leverage tool 10 by using either claw 18 or eyelet 20 of pry blade 16. In FIG. 1, the claw 18 is used to extract nail N by forcing pry blade 16 up against nail N such that nail N abuts claw 18. using the lower bend 13 as a pivot point or fulcrum, the worker may then press down on handle 12 to exert leverage upon nail N. As the claw 16 is engaged below the head of a nail N, the steeply inclined midsection 14 permits a relatively modest amount of downward force to be placed on handle 12 to act about the fulcrum, namely the lower bend 15, to translate into a larger amount of upward force by. pry blade 16 on nail N. Such force can be exerted over the entire arc over which the handle travels in a downward path towards the nailed surface, allowed by the steep angle of inclination of the tool. Such leverage is particularly advantageous in constricted work areas. The handle 12 is padded to provide cushioning to the hand as force is exerted downward.

Eyelet 20, located medially in pry blade 16 near lower bend 15, includes a hole 24 for passage of the head of a nail, and narrowed neck 22, used to extract nail N by placing head of nail N within hole 24 and drawing the narrowed neck 22 beneath the head. The eyelet 20 is configured to accommodate most standard building nail sizes. The nail being thus engaged, by placing an downward force on handle 12, the lower bend 13 again serves as a fulcrum and the downward force to translate into an increased upward force which forces up pry blade 16. The upward force extracts the nail N, which is secured within eyelet 20.

In contrast to FIG. 1 and as suggested by FIG. 3, the eyelet 20 allows the claw 18 to act as a fulcrum when an upward and forward force is exerted on handle 12. With the nail being engaged as previously described, by placing an upward force on handle 12, the tips 17 of the claw 16 serve as a fulcrum and the upward force to translates into an increased upward force which forces up pry blade 16. The upward force extracts the nail N, which is secured within eyelet 20.

The configuration of the upper bend 13 and lower bend 15 in leverage tool 10, in conjunction with handle 12, pry blade 16 and. midsection 14 causes leverage tool 10 to resemble an "Z" shape. In addition, the bends 13, and 15 are arranged with respect to midsection 14 such that handle 12 and pry blade 16 project oppositely therefrom and form an angle therebetween of about 135°. Furthermore, the angles of upper bend 13 and lower bend 15 are substantially complementary and place handle 12 and pry blade 16 in a substantially parallel relationship to each other.

The bends 13, 15, also allow leverage tool 10 to be utilized as a hammer, by a flattened transition portion 21 of midsection 14 and bend 15, opposite blade 16, functioning as the strike point. Unlike a conventional hammer, the user can both drive a nail and extract it without having to manually rotate the tool. Leverage tool 10 is made of materials chosen to be sufficiently rugged to endure the impact forces, such as steel or similar hard durable alloys. Handle 12 is made of rubber or other material suitable for gripping.

Figure 2:
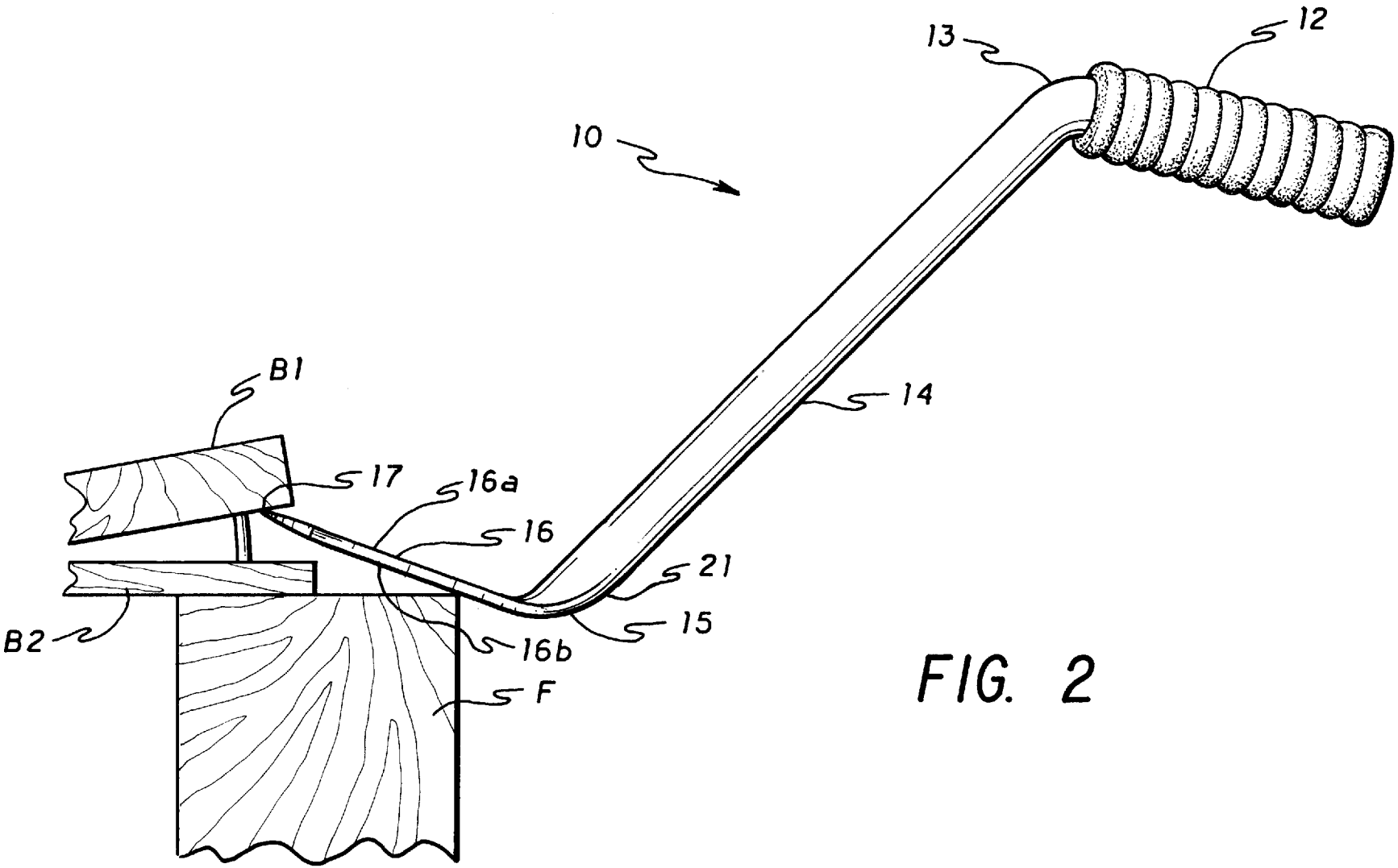
FIG. 2 is an environmental, side view of the present invention, showing the use thereof in lifting a beam nailed to a frame.

In FIG. 2 leverage tool 10 is shown as a tool for lifting upper beam B1 from frame F. Pry blade 16 is a rigid, thin, flat member having a planar face 16*a* and opposing surface 16*b*, thus dimensioned and configured to fit between two generally parallel contiguous surfaces, such as upper beam B1 and lower beam B2 shown, or shingles (not shown). The V-shaped tips 17 of pry blade 16 allow pry blade 16 to dig into soft building materials, such as wood, composites, asphalt and the like, thereby providing a surely set point with which to pry.

Substantial upper and lower bends 13, 15, respectively, allow a large upward force to be applied at pry blade 16 by applying only a minimum amount of downward force to handle 12. The moment force due to the moment arm of midsection 14 allows a person to lift a heavy object by first placing pry blade 16 between the object to be lifted and its support, and then exerting a downward force on handle 12. When utilized in this fashion leverage tool 10 is exceptional in assisting workers in lifting dressers, tables and other large objects (with tips 17 padded). In addition to lifting large objects, the added leverage gained from leverage tool 10 allows for the quick and efficient removal of shingles, siding, plywood, molding, roofing, metal and other hard to remove materials.

Claw 18 in use with eyelet 20 is particularly useful in nail extracting in situations where there is insufficient room to place a downward force on handle 12 as a consequence of its configuration. Claw 18 can be understood from FIG. 3 as being wider near the end provided with tips 17 (the distal end) and narrower proximate to lower bend 15 (the proximate end). Each V-shaped tip 17 has edges 19*a* and 19*b* converging towards an imaginary centerline of symmetry of pry blade 16. The line of symmetry beginning at the proximate end and ending at the distal end also defines the forward direction when the handle is brought upward. As opposed to using both tips 17 as a fulcrum when the handle is brought forward and upward, when the handle 12 is brought upward in a plane to the right or left of directly forward, an associated edge 19*a* or 19*b* acts as a fulcrum against which to act to remove the nail.

It is to be understood that the present invention is not limited to the sole embodiment described above, but encompasses any and all embodiments within the scope of the following claims.

I claim:

1. A leverage tool comprising:

an elongated member having a first end and a second end;

a handle of substantially shorter length than said elongated member, said handle integrally attached to said first end at an obtuse angle, said handle covered with a cushioning rubber material; and a pry blade member integrally attached to said second end, said pry blade member lying in a substantially parallel plane to said handle and extending from said elongated member in a diametrically opposite direction from said handle, said pry blade member including a claw having two pointed V-shaped tips disposed opposite said elongated member, said two pointed V-shaped tips defining a nail receiving notch therebetween, said pry blade member further including an eyelet having a hole for close passage of a head of a nail and having a narrowed neck.

2. The leverage tool according to claim 1, wherein said second end has a flattened portion for striking a nail.

3. The leverage tool according to claim 1, said obtuse angle being about 135°.

* * * * *